US005787724A

United States Patent [19]

Pohl et al.

[11] Patent Number: 5,787,724

[45] Date of Patent: Aug. 4, 1998

[54] DISPENSING ASSEMBLY FOR TOP MOUNT REFRIGERATOR

[75] Inventors: Douglas A. Pohl, Rio; Virgil R. Thompson, Galesburg, both of Ill.

[73] Assignee: Maytag Corporation, Newton, Iowa

[21] Appl. No.: 869,427

[22] Filed: Jun. 4, 1997

[51] Int. Cl.[6] ..... B47D 5/62

[52] U.S. Cl. ..... 62/389; 62/440; 49/381; 312/401; 312/405; 16/386

[58] Field of Search ..... 62/338, 339, 389, 62/390, 440, 441; 16/344, 343, 347, 386, 221; 491/192, 193, 381; 222/146.1, 146.6; 312/401, 405

[56] References Cited

U.S. PATENT DOCUMENTS

| | | | |
|---|---|---|---|
| 752,546 | 2/1904 | Harris et al. . | |
| 871,940 | 11/1907 | Koch . | |
| 2,914,218 | 11/1959 | Korodi . | |
| 3,429,140 | 2/1969 | White . | |
| 3,430,586 | 3/1969 | Sandin et al. | 62/440 |
| 3,511,415 | 5/1970 | Crowe . | |
| 3,908,394 | 9/1975 | Jacobus . | |
| 4,036,620 | 7/1977 | Benasutti et al. . | |
| 4,543,800 | 10/1985 | Mawby et al. . | |
| 4,912,942 | 4/1990 | Katterhenry et al. . | |
| 5,187,837 | 2/1993 | Gunderson et al. . | |
| 5,263,509 | 11/1993 | Cherry et al. . | |
| 5,666,764 | 9/1997 | Beatty et al. | 312/405 |

OTHER PUBLICATIONS

General Electric Company Service Bulletin "Refrigerator--Freezer TBX22/25PRY Models New Dispenser" dated Jun. 1996.

*Primary Examiner*—John M. Sollecito

*Attorney, Agent, or Firm*—Everett G. Diederiks, Jr.

[57] ABSTRACT

A top mount refrigerator having a freezer door pivotally mounted to a cabinet at a position spaced above a fresh food compartment door is provided with a dispenser assembly mounted in the freezer door. A water supply line for the dispenser assembly is routed to the freezer door through a center hinge unit for the two doors. In the preferred embodiment, the water supply line, which preferably leads from a water storage tank housed within the fresh food compartment, is routed to the center hinge unit through a lower hinge unit upon which the fresh food door is pivotally mounted and a conduit that is foamed in-situ within the fresh food door. In models incorporating a dispenser assembly requiring a supply of electrical power, wires are lead into the freezer door through an upper hinge unit associated with the freezer door.

19 Claims, 2 Drawing Sheets

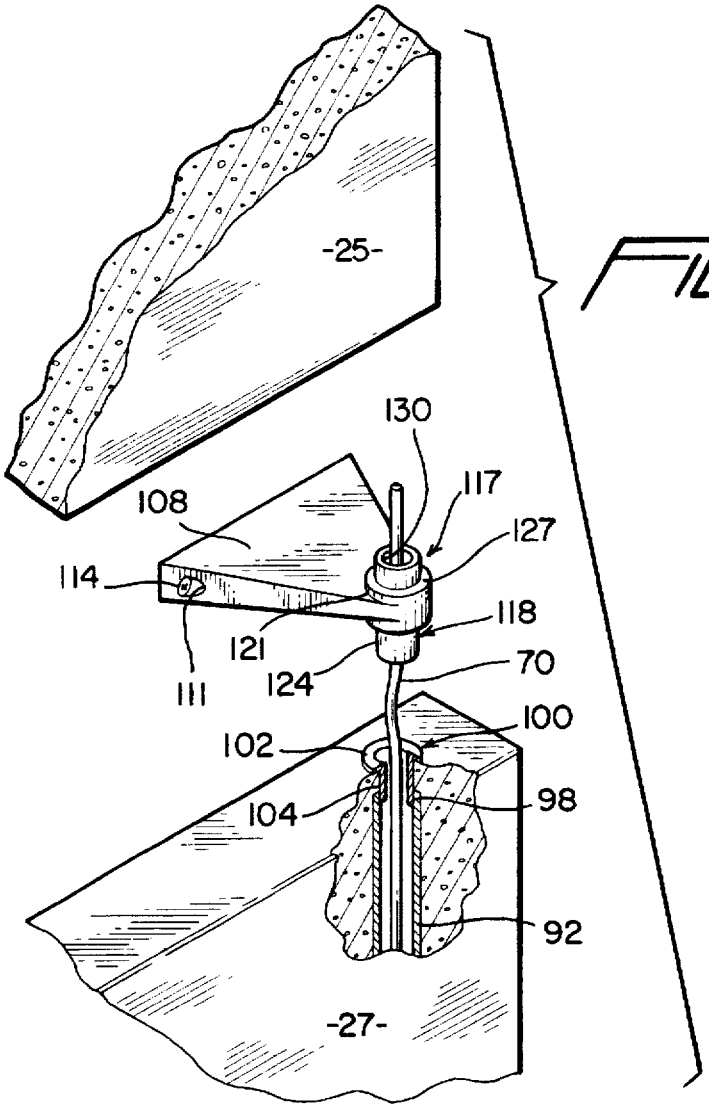
FIG. 3
FIG. 4
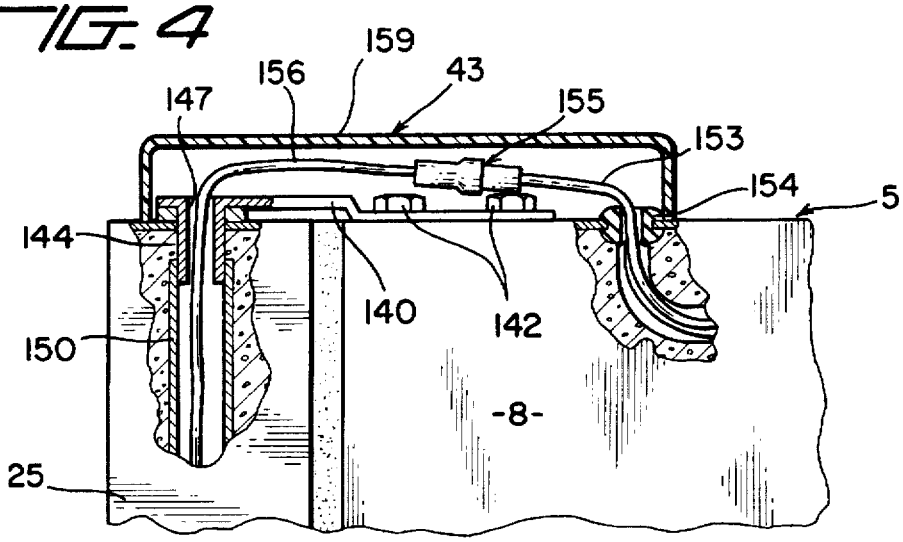

DISPENSING ASSEMBLY FOR TOP MOUNT REFRIGERATOR

BACKGROUND OF THE INVENTION

1. Field of the Invention

The present invention pertains to the art of refrigerators and, more particularly, to an arrangement for locating a dispenser in an upper door of a top mount refrigerator.

2. Discussion of the Art

Various styles of refrigerators are available on the market today. The most common styles include side-by-side refrigerators and top mount refrigerators. A side-by-side refrigerator is characterized as having a freezer compartment which is located laterally adjacent a fresh food compartment wherein, in a top mount refrigerator, the freezer compartment is located directly above the fresh food compartment. In either case, it is often desired to incorporate a dispenser assembly that is directly accessible from outside of the refrigerator. Such a dispenser assembly generally provides for the selective dispensing of water and ice, with the particular dispensing operation being controlled by manually adjusting a selector lever or pressing one or more electronic control switches.

For either style of refrigerator, the line that supplies the water commonly enters the cabinet of the refrigerator at the rear thereof, is routed to the fresh food compartment in order to be attached to a water storage tank and then leads to the dispenser assembly. In side-by-side refrigerators, the dispenser is almost invariably positioned in the freezer door. This is a convenient position, especially when an ice maker is incorporated as part of the overall dispenser assembly. With such an arrangement, it is known to extend the water supply line from the storage tank in the fresh food compartment to the dispenser in the freezer door through or directly adjacent a lower hinge upon which the door to the freezer is pivotally supported.

Although it has been proposed to incorporate ice only dispensers in the freezer doors of top mount refrigerators, a water or water/ice dispenser assembly would be variably mounted in the door sealing the fresh food compartment. This arrangement still enables the lower hinge to accommodate the passage of the water supply line and minimizes the distance between the water storage tank and the dispenser itself, however, somewhat elaborate design measures must be taken to provide for the timely flow of ice from the freezer compartment. In addition, the fresh food compartment door must remain closed during use of the dispensing assembly and therefore refrigerated beverages which may be placed in a drinking container in combination with ice from the dispenser cannot be accessed until after the ice dispensing operation is performed. Furthermore, since a wide range of models which can vary considerably in size are produced in today's marketplace, it would be much more desirable to locate a water or water/ice dispenser assembly higher on some refrigerator models. Although this would not present a problem on a side-by-side refrigerator, the repositioning of such a dispenser assembly vertically in the fresh food compartment door of a top mount refrigerator raises some serious engineering considerations.

It is in view of these problems and concerns that the present inventors considered the desirability of mounting a water or water/ice dispenser assembly in the freezer door of a top mount refrigerator. Although such an arrangement would locate the dispenser assembly in a more advantageous position relative to the supply of ice, additional problems arise, including considerations with regard to the routing of the water supply line where it will not be adversely exposed to below freezing temperatures. Furthermore, if the dispenser assembly requires an electrical power source, wires would have to be run. Still, based on the above, there exists a need in the art for an improved dispensing assembly for use with top mount refrigerators.

SUMMARY OF THE INVENTION

The present invention is directed to the mounting of a water or water/ice dispenser assembly in the freezer door of a top mount refrigerator. The dispenser assembly receives a supply of water from a line that is routed through a center hinge unit used, in combination with upper and lower hinge units, to pivotally mount the freezer and fresh food doors of the refrigerator. Once extended through the center hinge unit, the water line can be isolated from extreme low temperatures by foamed insulation injected in the freezer door. In a preferred embodiment, the water supply line extends through the lower hinge unit, through a conduit foamed in-situ within the fresh food door, through the center hinge unit and to the dispenser through the freezer door. The center hinge is preferably molded as a single piece and includes a bracket portion for securing the same relative to a shell of the refrigerator.

In models wherein the dispenser assembly is provided with an electrical source of power, the necessary wires are preferably routed through the upper hinge unit for the freezer door. This advantageously maintains the structural integrity of the doors by minimizing the diameter of the bores that would have to be provided in the various hinge units if the wires were routed along the same path as the water supply line. This can be of particular importance on larger size refrigerators wherein the doors have the capacity to support a considerable number of items which tend to place rather high loads on the various hinge units.

Additional features and advantages of the invention will become more readily apparent from the following detailed description of a preferred embodiment thereof when taken in conjunction with the drawings wherein like reference numerals refer to corresponding parts in the several views.

BRIEF DESCRIPTION OF THE DRAWINGS

FIG. 3 is an exploded and partially sectioned view of a central hinge area of the top mount refrigerator of FIG. 1; and FIG. 4 is a partially sectioned side view of a top corner area of the refrigerator of FIG. 1.

DETAILED DESCRIPTION OF THE PREFERRED EMBODIMENT

Figure 1:
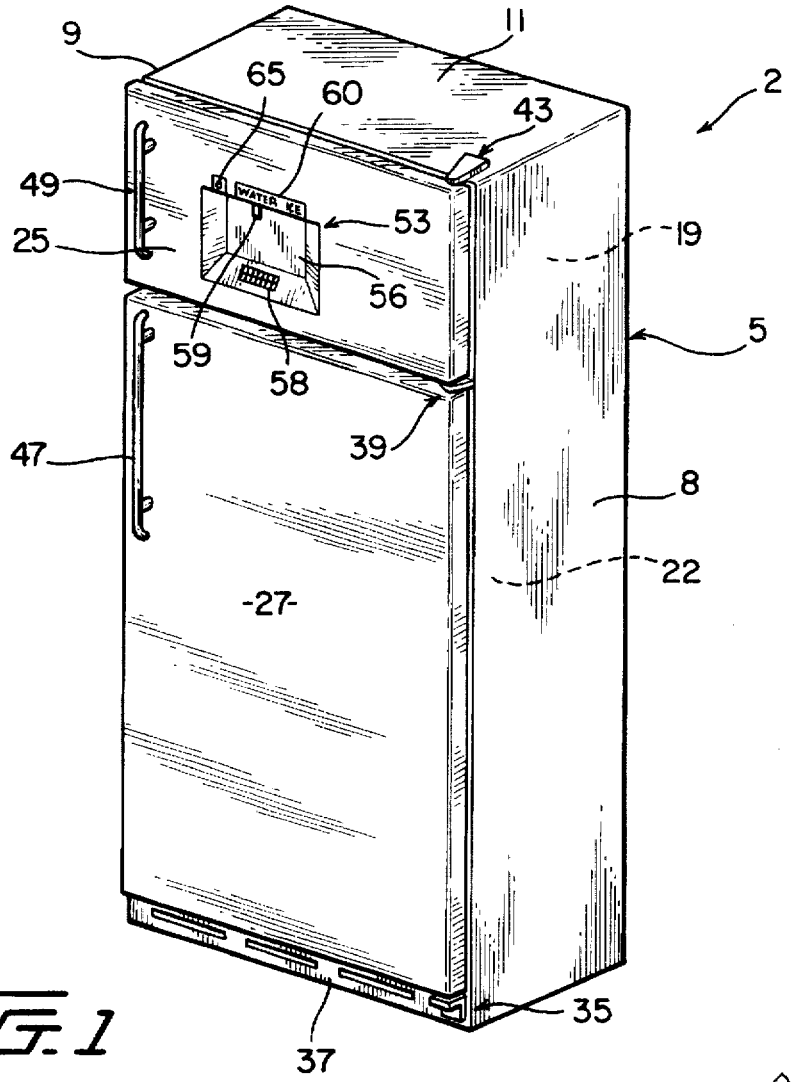
FIG. 1 is a perspective view of a top mount refrigerator according to the invention.

With initial reference to FIG. 1, a top mount refrigerator cabinet constructed in accordance with the present invention is generally indicated at 2. Cabinet 2 includes a cabinet shell 5 defined, at least in part, by first and second upstanding side panels 8 and 9 that are interconnected and laterally spaced by a top panel 11. Although not shown in this figure, cabinet shell 5 would also include a rear panel and internal reinforcing structure. Since refrigerator cabinet 2 represents a top mount-type refrigerator, a mullion (not labeled) is provided which extends laterally across shell 5 and divides refrigerator cabinet 2 into an upper freezer compartment 19 and a lower fresh food compartment 22. Although not particularly illustrated, both the freezer and fresh food compartments 19 and 22 would be defined by respective liners installed within shell 5 in a manner known in the art.

As illustrated, a freezer door 25 is provided to selectively seal freezer compartment 19 and a fresh food or refrigerator door 27 is provided to selectively seal fresh food compartment 22. Refrigerator door 27 is actually mounted for pivotal movement relative to shell 5 by means of a lower hinge unit 35 that is secured to reinforcement structure of cabinet 2 at the level of a conventional kickplate 37 and a center hinge unit 39. Freezer door 25 is also mounted through center hinge unit 39 and an upper hinge unit 43 for pivotal movement relative to shell 5 in order to provide selective access to within upper freezer compartment 19. In order to open and close doors 25 and 27, refrigerator and freezer door handles 47 and 49 are respectively provided.

The above description merely refers to conventional top mount refrigerator structure. The present invention is actually directed to the mounting of a dispensing assembly 53 in the upper freezer door 25 of cabinet 2 as generally shown in FIG. 1. As illustrated, dispensing assembly 53 defines a recessed area 56 within which a beverage container can be placed, above a catch tray 58, in order to selectively receive water or ice therefrom. Dispensing assembly 53 is shown to include a selector lever 59 positioned at a display 60 for manually determining the function of the dispensing assembly 53 to be performed. At this point, it should be realized that dispensing assembly 53 can take various forms without departing from the spirit of the invention. For example, dispensing assembly could incorporate a light controlled by means of a switch 65 or could be entirely electronically controlled. Given that dispensing assembly 53 is mounted in freezer door 25, the delivery of ice, whether in cubed or crushed form, is obviously simplified as compared to providing the dispensing assembly 53 in refrigerator door 27. However, provisions have to be made for delivering a supply of water to dispensing assembly 53, as well as electrical power in embodiments requiring the same. The preferred embodiment for accomplishing these tasks in accordance with the invention will now be described in detail.

Figure 2:
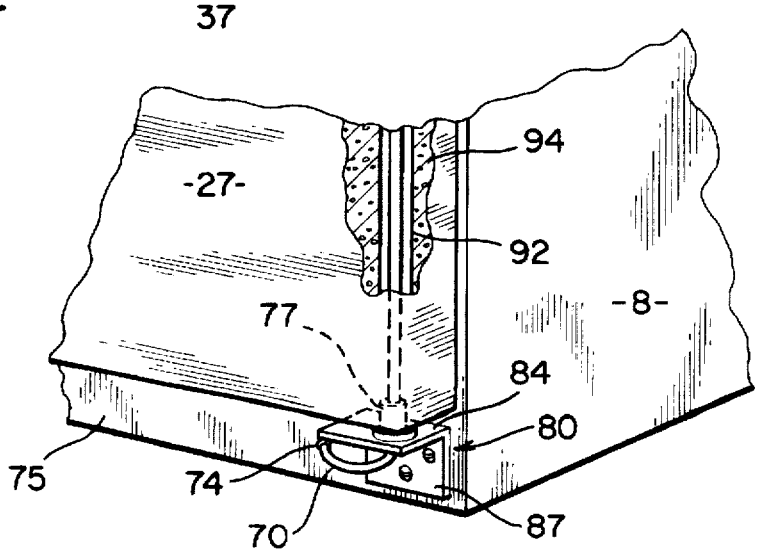
FIG. 2 is a partially sectioned and perspective view of a lower corner of the refrigerator of FIG. 1.

As mentioned above, it is desirable to have a water supply line extend to a water storage tank located in the fresh food compartment of a refrigerator such that a predetermined supply of water can be maintained cool before delivery to a dispensing fountain. For the sake of convenience, entry into or out of the fresh food compartment is typically made either through the rear of the refrigerator cabinet or through the bottom thereof. In accordance with the present invention, as best shown in FIG. 2, a water supply line 70 is run under refrigerator cabinet 2 and emerges through a hole or slot 74 provided in a front kickface member 75. Supply line 70 then extends through an upstanding pin 77 supported by a bracket 80 that defines lower hinge unit 35. Bracket 80 actually includes an upper plate 84 and a rear plate 87. Rear plate 87 is used to secure bracket 80 to cabinet 2 by means of screws or the like (not shown). Actually, upstanding pin 77 is fixedly secured to upper plate 84 and extends into refrigerator door 27 and defines an upright axis about which door 27 can rotate. Pin 77 is provided with a bore (not separately labeled) that is alinged with an aperture (not shown) formed in upper plate 84 through which water supply line 70 extends. A conduit 92, which can be made of various materials but is preferably molded of plastic, is arranged within refrigerator door 27 and water supply line 70 is routed within conduit 92. Conduit 92 is fixedly secured within refrigerator door 27 following the injection of foamed insulation 94 therein.

FIG. 3 illustrates the manner in which water supply line 70 exits refrigerator door 27 and is delivered into freezer door 25. As shown, conduit 92 has an upper end 98 that terminates within refrigerator door 27. Connected to upper end 98 is a tubular bearing sleeve 100. More specifically, tubular bearing sleeve 100 includes an annular flange 102 and a tubular body 104. Tubular body 104 extends into an aperture (not labeled) provided in refrigerator door 27 and is received within conduit 92 until annular flange 102 engages refrigerator door 27. In accordance with the invention, the tubular bearing sleeve 100 can be secured to conduit 92 and refrigerator door 27 in various manners, such as by a press-fit connection or through the use of an adhesive. Although not shown in detail, a similar construction is provided at the bottom of refrigerator door 27.

Once water supply line 70 exits refrigerator door 27, it passes through center hinge unit 39 in order to enter freezer door 25. As shown in FIG. 3, center hinge unit 39 preferably comprises a mounting bracket 108 including a plurality of recessed mounting holes, one of which is shown at 111, for receiving a mechanical fastener such as a screw 114 in order to fixedly secure center hinge unit 39 relative to shell 5 at mullion 15. Center hinge unit 39 actually includes upper and lower hinge elements 117 and 118, each of which includes a first diametric portion 121 and a second, reduced diametric portion 124. The second diametric portions 124 actually define hinge pins which are received within respective tubular bearing sleeves 100 provided in the freezer and refrigerator doors 25 and 27. The first and second diametric portions 121 and 124 of each hinge element 117, 118 meet to form a respective shoulder 127 which acts as a bearing surface. Center hinge unit 39 is provided with a central bore 130 that extends through each of the first and second diametric portions 121 and 124. With this arrangement, water supply line 70 can be easily routed through center hinge unit 39 in order to enter freezer door 25. Once within freezer door 25, water supply line 70 can be lead to dispensing assembly 53, either directly or through the use of a conduit arrangement similar to that discussed above with respect to the routing of water supply line 70 through refrigerator door 27. In the preferred embodiment shown, center hinge unit 39 is made of a single piece that is preferably injection molded of plastic, however, it should be realized that the center hinge unit 39 could be made of various pieces including separate hinge defining members for the freezer and refrigerator doors 25 and 27 respectively.

As mentioned above, if dispensing assembly 53 requires electrical power, provisions must be made to accommodate the routing of the wires. Although such wires could be run together with water supply line 70, this would require the bores in hinge pin 77 and center hinge unit 39 to be increased in size to some degree which would tend to require larger sized members to be used. Instead, in accordance with the present invention, upper hinge unit 43 is structured to accommodate the passage of wires. More specifically, as best shown in FIG. 4, upper hinge unit 43 includes a hinge plate 140 that is secured to shell 5 by various screws 142. Hinge plate 140 is integrally formed with or has securely attached thereto a downwardly extending hinge pin 144 that is provided with a central through hole 147. Hinge pin 144 is received within a tubular bearing sleeve member 150 carried by freezer door 25. A plurality of wires 153 emerge from within cabinet shell 5 through a grommet 154 located behind hinge plate 140 and then are attached through a harness 155 to a corresponding plurality of wires 156. Wires 156 are routed above hinge plate 140 and into freezer door 25 via through hole 147 provided in hinge pin 144. Wires 156 could simply be molded in-situ within freezer door 25 or could be run within a conduit (not shown). A cover member 159 is adapted to be snap-fit or otherwise attached atop hinge plate 140 to cover hinge plate 140, wires 153, grommet 154, harness 155 and wires 156.

With the above described arrangement, it should be readily apparent that the dispensing assembly of the invention is advantageously positioned in the freezer door of a top mount refrigerator and provisions are made to accommodate the delivery of electrical wires and/or a water supply line for the assembly. However, although described with respect to a preferred embodiment of the invention, it should be readily understood that various changes and/or modifications can be made to the invention without departing from the spirit thereof. In general, the invention is only intended to be limited by the scope of the following claims.

We claim:

1. A top mount refrigerator cabinet assembly comprising:

a cabinet shell including upstanding side panels which are interconnected and spaced by a top panel, said cabinet shell including a generally open front leading to within said cabinet shell;

a mullion extending between said side panels at a position spaced below said top panel wherein said mullion divides said cabinet shell into upper and lower refrigeration compartments including a lower, fresh food compartment and a freezer compartment located above the fresh food compartment;

a lower hinge unit attached to said shell adjacent a lower front comer thereof;

an upper hinge unit attached to said shell adjacent an upper front comer thereof;

a central hinge unit located between said upper and lower hinge units, said central hinge unit including upper and lower hinge elements, with said central hinge unit being formed with a bore therein;

a first door having a lower end portion rotatably mounted to said lower hinge unit and an upper end portion rotatably mounted to the lower hinge element of said central hinge unit to enable said first door to be pivoted about a first axis defined by said lower hinge unit and the lower hinge element of said central hinge unit between a closed position wherein said first door extends across said fresh food compartment at the front of said cabinet shell and an open position permitting access to within said fresh food compartment;

a second door having a lower end portion rotatably mounted to the upper hinge element of said central hinge unit and an upper end portion rotatably mounted to said upper hinge unit to enable said second door to be pivoted about a second axis defined by said upper hinge unit and the upper hinge element of said central hinge unit between a closed position wherein said second door extends across said freezer compartment at the front of said cabinet shell and an open position permitting access to within said freezer compartment;

a dispensing unit located in a front wall section of said second door; and a water supply line extending from within the fresh food compartment of said cabinet shell to said dispensing unit through the bore formed in said central hinge unit and the second door.

2. The refrigerator cabinet assembly according to claim 1, wherein the lower hinge element of said central hinge unit is formed integral with the upper hinge element thereof.

3. The refrigerator cabinet assembly according to claim 2, wherein said central hinge unit further includes a bracket member interconnecting the upper and lower hinge elements to said cabinet shell.

4. The refrigerator cabinet assembly according to claim 3, wherein said bracket member, said upper hinge element and said lower hinge element of said central hinge unit are formed as a single, molded piece.

5. The refrigerator cabinet assembly according to claim 2, wherein each of said upper and lower hinge elements includes a first diametric portion and a second, reduced diametric portion with the second, reduced diametric portion of said upper hinge element projecting into the second door and the second, reduced diametric portion of said lower hinge element projecting into the first door.

6. The refrigerator cabinet assembly according to claim 1, further comprising a conduit foamed in-situ within said first door, said water supply line extending through said conduit.

7. The refrigerator cabinet assembly according to claim 6, further comprising a tubular bearing sleeve having an annular flange portion and a tubular body portion, wherein said annular flange abuts the upper end portion of said first door and said tubular body extends into said conduit.

8. The refrigerator cabinet assembly according to claim 1, where in said upper hinge unit is provided with a through hole leading into said second door, said refrigerator cabinet assembly further comprising a plurality of wires for providing electrical power to said dispensing unit, said plurality of wires extending to said dispensing unit from within said second door via said through hole.

9. The refrigerator cabinet assembly according to claim 8, further comprising a cover positioned over said upper hinge unit.

10. The refrigerator cabinet assembly according to claim 9, wherein the plurality of wires lead into said through hole from a position spaced rearward of the upper hinge unit and said cover encloses the plurality of wires.

11. In a refrigerator having an upper freezer compartment adapted to be sealed by a freezer door pivotally mounted through an upper hinge unit and a central hinge unit and a lower fresh food compartment adapted to be sealed by a refrigerator door pivotally mounted through a lower hinge unit and the central hinge unit, a dispensing assembly comprising:

a dispensing unit located in a front wall section of said freezer door; and a supply line extending through both said central hinge unit and said freezer door for delivering water to said dispensing unit.

12. The dispensing assembly according to claim 11, wherein said central hinge unit includes a lower hinge element to which the fresh food door is rotatably mounted and an upper hinge element to which the freezer door is rotatably mounted, said supply line extending through a bore formed in said central hinge unit.

13. The dispensing assembly according to claim 12, wherein said central hinge unit further comprises a bracket member formed as a single, molded piece with the lower and upper hinge elements.

14. The dispensing assembly according to claim 12, wherein each of said upper and lower hinge elements includes a first diametric portion and a second, reduced diametric portion with the second, reduced diametric portion of said upper hinge element projecting into the freezer door and the second, reduced diametric portion of said lower hinge element projecting into the refrigerator door.

15. The dispensing assembly according to claim 12, further comprising a conduit foamed in-situ within said refrigerator door, said supply line extending through said conduit.

16. The dispensing assembly according to claim 15, further comprising a tubular bearing sleeve having an annular flange portion and a tubular body portion, wherein said annular flange abuts an upper end portion of said refrigerator door and said tubular body extends into said conduit.

17. The dispensing assembly according to claim 11, wherein said upper hinge unit is provided with a through hole leading into said freezer door, said dispensing assembly further comprising a plurality of wires for providing electrical power to said dispensing unit, said plurality of wires extending to said dispensing unit from within said freezer door via said through hole.

18. The dispensing assembly according to claim 17, further comprising a cover positioned over said upper hinge unit.

19. The dispensing assembly according to claim 18, wherein the plurality of wires lead into said through hole from a position spaced rearward of the upper hinge unit and said cover encloses the plurality of wires.

* * * * *